United States Patent [19]

Hosaka et al.

[11] 4,171,297

[45] Oct. 16, 1979

[54] ANTI-CREVICE CORROSION SEALANTS FOR METALS

[75] Inventors: Nobuyoshi Hosaka, Minorimachi; Tetsuo Nakazawa, Shimoinayoshi, both of Japan

[73] Assignee: Hitachi Ltd., Japan

[21] Appl. No.: 831,412

[22] Filed: Sep. 8, 1977

[30] Foreign Application Priority Data

Oct. 6, 1976 [JP] Japan ..... 51-119341

[51] Int. Cl.[2] ..... C08K 5/09

[52] U.S. Cl. ..... 260/31.2 R; 252/394; 260/42.15; 260/42.22

[58] Field of Search ..... 106/1, 14, 287 SE; 260/31.2 R, 42.22, 42.15; 252/390, 394

[56] References Cited

U.S. PATENT DOCUMENTS

| | | | |
|---|---|---|---|
| 2,837,432 | 6/1958 | Drigot et al. | 106/14 |
| 3,730,746 | 5/1973 | Boaz | 106/14 |
| 3,884,705 | 5/1975 | Blair | 260/42.22 |

*Primary Examiner*—Harold D. Anderson
*Assistant Examiner*—W. Thompson
*Attorney, Agent, or Firm*—Craig and Antonelli

[57] ABSTRACT

Anti-crevice corrosion sealants for metals obtained by adding a mixture of zinc powder and dicyclohexylammonium nitrite powder bound by a vinyl silane coupling agent to a film-forming polystyrene dissolved in a solvent can restrain crevice corrosion occurring at crevices or jointed interior surfaces by filling the sealants into a fine crevice formed between the elements of metal machinery and tools or onto the jointed interior surface of the elements.

2 Claims, 1 Drawing Figure

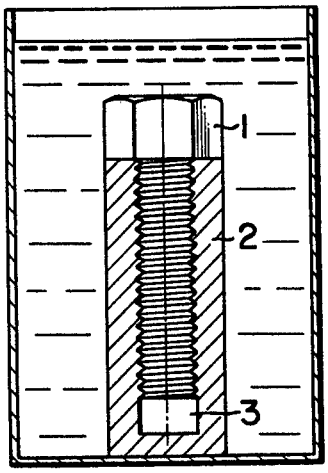
1
2
3

ANTI-CREVICE CORROSION SEALANTS FOR METALS

LIST OF PRIOR ART (37 CFR 1.56(a))

The following references are cited to show the state of the art:

Japanese Patent Kokoku (Post-Exam. Publn.) No. 20,954/75

Japanese Patent Kokoku (Post-Exam. Publn.) No. 20,955/75

Japanese Patent Kokai (Laid-Open) No. 133,239/74

Japanese Patent Kokai (Laid-Open) No. 105,942/76

Japanese Patent Kokai (Laid-Open) No. 109,239/76

BACKGROUND OF THE INVENTION

The present invention relates to anti-crevice corrosion sealants for metals which can restrain crevice corrosion occurring at fine crevices formed between the elements of metal machinery and tools or on the jointed interior surface of the elements.

It is known that corrosion, referred to as "crevice corrosion" in the art occurs at fine crevices between the elements of metal machinery and tools, for example, the joined interior surfaces of flanges or the crevice between the screw surface of a bolt and a tapped hole when said metal machinery and tools are used in water or sea water (hereinafter referred to simply as "sea water, etc."). This phenomenon appears particularly remarkably in sea water rather than in fresh water and in the case of stainless steel or aluminum which are easy to be brought to a passive state.

It is considered that one reason for the crevice corrosion is an oxygen concentration cell action due to a difference between the oxygen concentration in the liquid present in crevices and the oxygen concentration at parts remote from crevices. Further, a reduction of the pH of the liquid in crevices due to the dissolution of the metal surface is considered to be another reason therefor.

As a process for restraining crevice corrosion, there have heretofore been known a process which comprises coating a paint onto the head of a bolt after bolting and a process which comprises covering the head of a bolt with a lining material. According to the process which comprises coating a paint, however, it is inevitable that the liquid penetrates into the crevices after use for a long period of time. Such is also the case with the process which comprises covering with a lining material. In both of the processes, crevice corrosion occurs. Further, there are a process which comprises adding a cation exchange substance into crevices to remove chloride ion and restrain crevice corrosion, a process which comprises applying a sheet impregnated with an alkali such as sodium silicate to crevices and prevent the acidification of the liquid in the crevice, and a process which comprises adding an inhibitor of chromate and bichromate series, nitrate series or primary, secondary and tertiary phosphates series to crevices. However, all the processes can not obtain a satisfactory anticorrosion effect.

Therefore, an object of the present invention is to obviate the above-mentioned defects of prior art anti-crevice corrosion sealants (hereinafter referred to simply as "sealants") for metals.

Another object of the invention is to provide a sealant for metals which can restrain the occurrence of crevice corrosion by filling it into crevices.

The other objects and advantages of the present invention will be apparent from the following description.

BRIEF DESCRIPTION OF THE INVENTION

According to the present invention, there is provided a sealant for metals comprising a mixture of zinc powder and dicyclohexylammonium nitrite powder, a vinyl silane coupling agent and film-forming polystyrene dissolved in a solvent. Crevice corrosion can be restrained effectively by filling the sealant into fine crevices between a bolt and a tapped hole or onto the interior jointed surface of the elements of stainless steel machinery and tools.

BRIEF DESCRIPTION OF THE DRAWING

The accompanying drawing shows a corrosion tester for measuring the effect of the sealant for metals according to the present invention.

DETAILED DESCRIPTION OF THE INVENTION

The sealant for metals according to the present invention comprises a material obtained by adding zinc powder and dicyclohexylammonium nitrite powder to a vinyl silane coupling agent, film-forming polystyrene dissolved in a solvent and optionally a phthalic acid ester.

More specifically, the sealant for metals according to the present invention comprises 4 to 15 parts by weight of a mixture consisting of 5 to 30% by weight of a material obtained by adding 4 to 15 parts by weight of a mixture consisting of 99 to 80% by weight of zinc powder (particle size 0.001 to 0.1 mm) and 1 to 20% by weight of dicyclohexylammonium nitrite powder (particle size 0.001 to 0.1 mm) to 1 part by weight of a vinyl silane coupling agent and 95 to 70% by weight of a solution obtained by adding 5 to 40% by weight of polystyrene to 95 to 60% by weight of a solvent of ethyl acetate series.

In order to impart plasticity to the sealant, the sealant may comprise 5 to 30% by weight of said material and 95 to 70% by weight of a solution obtained by adding 5 to 40% by weight of a mixture consisting of film-forming polystyrene and a small amount (1 to 10% by weight) of a phthalic acid ester to 95 to 60% by weight of a solvent of ethyl acetate series.

It is preferable that the particle size of zinc powder is 0.001 to 0.1 mm. The particle size of less than 0.001 mm is uneconomical in that the cost of pulverization is increased. At a particle size of more than 0.1 mm, dispersion becomes uneven and adhesiveness of the sealant to the metal surface becomes poor, resulting in the reduction of anticorrosion effect.

As for the amount of dicyclohexylammonium nitrite powder added to zinc powder, the amount of less than 1% by weight can not give satisfactory anticorrosion effect. Also, if the amount is more than 20% by weight, dispersion becomes uneven and sealing property is deteriorated on the exhaustion of dicyclohexylammonium nitrite.

As for the amount of a mixture of zinc powder and dicyclohexylammonium nitrite powder added to a vinyl silane coupling agent, when the amount is less than 4 times the weight of the vinyl silane coupling agent, satisfactory anticorrosion effect can not be obtained.

Also, when the amount is more than 5 times the weight of the vinyl silane coupling agent, viscosity is lost and adhesiveness is reduced.

As the vinyl silane coupling agent, there may be used, for example, vinyltrichlorosilane, vinyltriethoxysilane, vinyltricellosolve ester silane, vinyltrimethoxysilane, vinyltris(2-methoxyethoxy) silane, etc. which are all commercially available.

Also, as the phthalic acid ester, there may be used any phthalic acid ester which is generally used as a plasticizer, for example, dibutyl phthalate, di-2-ethylhexyl phthalate, di-n-octyl phthalate, diisooctyl phthalate, dilauryl phthalate, butyloctyl phthalate, butyldecyl phthalate, butylauryl phthalate, butylphthalyl butylglycollate, etc.

As for the amount of a mixture of zinc powder, dicyclohexylammonium nitrite powder and a vinyl silane coupling agent added to a polystyrene solution, sealing property is poor when the amount is less than 5% by weight. Also, when the amount is more than 30% by weight, satisfactory anti-corrosion effect can not be obtained.

In the prevention of crevice corrosion of metals, the above-mentioned compositions act effectively. As for said oxygen concentration cell action, dicyclohexylammonium nitrite acts effectively. Specifically, the cyclohexyl nucleus-containing nitrite group of dicyclohexylammonium nitrite is vaporized in a molecular state in crevices and adsorbed onto the metal surface. Thus, a passive film is formed on the metal surface. Thereby, even if sea water, etc. penetrate crevices, oxygen consumption in the crevices is suppressed and a difference in oxygen concentration does not occur. Therefore, the occurrence of crevice corrosion can be restrained by said oxygen concentration cell action.

Also, when machinery and tools are used in sea water, etc. for a long period of time, the sealing property of the corrosion inhibitor is deteriorated, and sea water, etc. penetrate into crevices, zinc acts effectively. It is well known that zinc shows in sea water, etc. a less noble potential than iron, stainless steel and aluminum. Therefore, zinc present on the metal surface is dissolved in preference to said metals, and the dissolution of the metal surface is suppressed. Further, the dissolved zinc combines with the hydroxyl ion ($OH^-$) of sea water, etc. in the crevices to form amorphous zinc hydroxide $Zn(OH)_2$. Since the pH in the crevices is maintained at 10–11 by the zinc hydroxide, the oxide film of the metal surface is stably protected.

Also, since the zinc hydroxide is surrounded by polystyrene film, the zinc hydroxide is difficult to be eluted and remains in the crevices. Thus, the anti-corrosion effect can be retained for a long period of time. Other advantageous properties of this invention result from the fact that metallic zinc particles are encapsulated by thin polystyrene films, but after the solvent for polystyrene polymer dries, many micro-cracks occur at the surface of polystyrene encapsulation, thus bringing metallic zinc particles into contact with the crevice metal surface.

Furthermore, the liquid penetrates to the encapsulated zinc through the micro-cracks and reacts with the metallic zinc to form amorphous zinc hydroxide which is effective to prevent crevice corrosion. The thin polystyrene shell prevents the zinc hydroxide from diffusing out of the crevice and the thus remaining zinc hydroxide can prevent crevice corrosion for a long period of time.

The following example illustrates the present invention.

EXAMPLE

Test pieces 1 and 2 of stainless steel (chemical composition of which is shown in Table 1) as shown in the accompanying drawing are prepared. These test pieces 1 and 2 are assembled by filling the following sealants—1 to —3 into the fine crevice formed by the test pieces 1 and 2.

Sealant—1 (Referential Example)

(a) Preparation of a mixed powder—90% by weight of zinc dust (particle size 0.005–0.05 mm) is mixed with 10% by weight of dicyclohexylammonium nitrite powder (particle size 0.001 to 0.1 mm).

(b) 1 Part by weight of vinyl silane coupling agent is added to 3.5 parts by weight of the mixed powder obtained in (a).

(c) 20% by weight of the material obtained in (b) above is mixed with 80% by weight of a polystyrene solution obtained by mixing 70% by weight of ethyl acetate with 30% by weight of polystyrene.

Sealant—2

4 Parts by weight of the mixed powder obtained in the same manner as in said Sealant—1 is mixed with 1% by weight of vinyl silane coupling agent. A sealant is prepared by the use of the material thus obtained in the same manner as in (c) above.

Sealant—3

15 Parts by weight of the mixed powder obtained in the same manner as in said Sealant—1 is mixed with 1 part by weight of vinyl silane coupling agent. A sealant is prepared by the use of the material thus obtained in the same manner as in (c) above.

The test pieces 1 and 2, assembled as described above, are dipped in a 3% aqueous sodium chloride solution at 25° C. for 720, 1440 and 4320 hours, respectively. The test pieces 1 and 2 are then removed from the solution and the test piece 1 is drawn out to observe the occurrence of corrosion in crevice. Further, the penetration of the solution into a reservoir 3, sealing property and the pH of the solution in the reservoir are measured. The results obtained are shown in Table 2. Also, for comparison, the results of a prior art sealing material closest to the sealants of the present invention are shown in the table. It is found from the table that the sealants of the present invention are more effective than the prior art sealing material.

Table 1

| Chemical composition of test pieces (%) | | | | | | |
|---|---|---|---|---|---|---|
| C | Si | Mn | P | S | Cr | Ni |
| 0.07 | 0.90 | 1.25 | 0.010 | 0.009 | 19.30 | 9.62 |

Table 2

| Dip test results | | | | |
|---|---|---|---|---|
| Sealing materials | Measurement item | Time (hours) 720 | 1440 | 4320 |
| Prior art sealing material | pH | 8–9 | 8–9 | 6–7 |
| | Penetration | No | No | Yes* |
| Sealant-1 | pH | 9–10 | 9–10 | 8–9 |
| | Penetration | No | Yes | * |
| Sealant-2 | pH | 10–11 | 10–11 | 10–11 |

Table 2-continued

| Sealing materials | Measurement item | Dip test results Time (hours) 720 | 1440 | 4320 |
|---|---|---|---|---|
| Sealant-3 | Penetration | No | No | No |
| | pH | 10–11 | 10–11 | 10–11 |
| | Penetration | No | No | No |

Note:
1. *Crevice corrosion was observed.
2. pH values represent minimum value and maximum value.

What is claimed is:

1. An anti-crevice corrosion sealant for metals comprising: (a) 5 to 30% by weight of a material comprising 4 to 15 parts by weight of a mixed powder consisting of 99 to 80% by weight of zinc powder, 1 to 20% by weight of dicyclohexylammonium nitrite powder, and 1 part by weight of a vinyl silane coupling agent, and (b) 95 to 70% by weight of a film-forming polystyrene solution consisting of 5 to 40% by weight of a film-forming polystyrene and 95 to 60% by weight of ethyl acetate, whereby when said anti-crevice corrosion sealant is applied to a crevice, the particles of the zinc powder are encapsulated by polystyrene film, which film has micro-cracks formed therein as the solvent for the polystyrene dries up.

2. An anti-crevice corrosion sealant according to claim 1, wherein the zinc powder has a particle size with the range of 0.001 to 0.1 mm.

* * * * *